United States Patent [19]

Musgrave

[11] 4,100,694

[45] Jul. 18, 1978

[54] READY MAGAZINE HOLDER

[76] Inventor: Daniel Dennis Musgrave, 8201 Caraway St., Cabin John, Md. 20731

[21] Appl. No.: 839,596

[22] Filed: Oct. 5, 1977

[51] Int. Cl.[2] ..... F41C 27/00

[52] U.S. Cl. ..... 42/90; 42/1 R

[58] Field of Search ..... 42/90, 1 R, 18, 71 R, 42/72, 50

[56] References Cited

U.S. PATENT DOCUMENTS

| | | | |
|---|---|---|---|
| 2,130,383 | 9/1938 | End | 42/18 |
| 2,289,067 | 7/1942 | Owsley | 42/50 |
| 2,324,125 | 7/1943 | Van Horn et al. | 42/72 |
| 2,325,484 | 7/1943 | Kiraly et al. | 42/18 |
| 2,931,120 | 4/1960 | Kolin | 42/18 |
| 3,623,256 | 11/1971 | Shiplee | 42/50 |

*Primary Examiner*—Charles T. Jordan

[57] ABSTRACT

A holder for supporting a cartridge magazine on a firearm in a convenient location and in a proper orientation for rapid insertion into the magazine receptacle of the firearm. The holder can be attached to existing firearms, or it can be manufactured as a part of new firearms.

9 Claims, 7 Drawing Figures

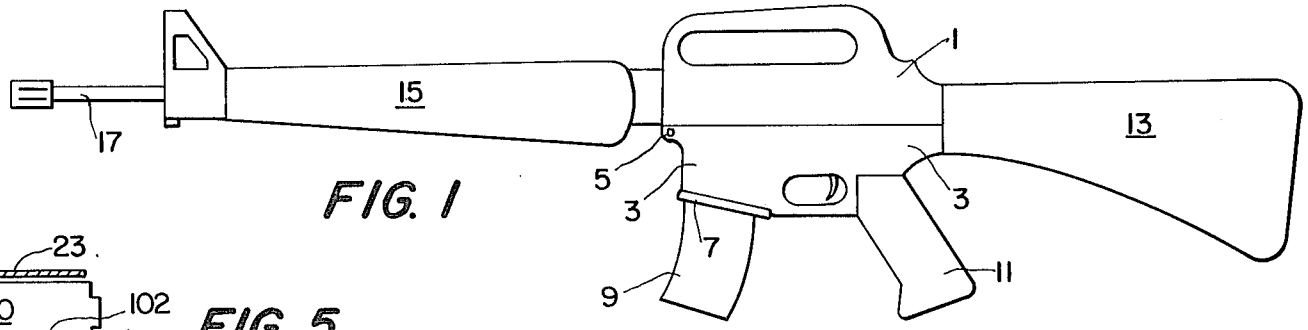
FIG. 1
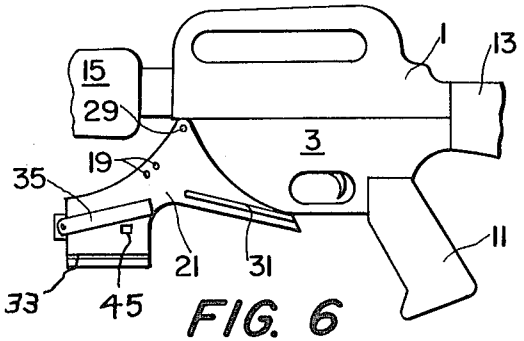
FIG. 6
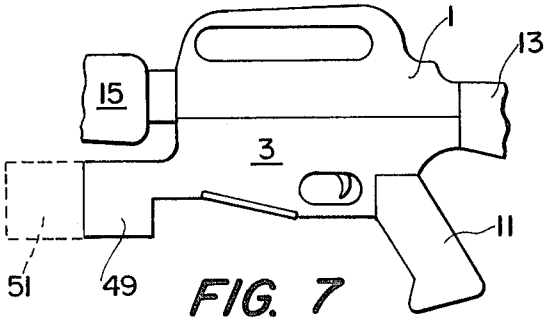
FIG. 7
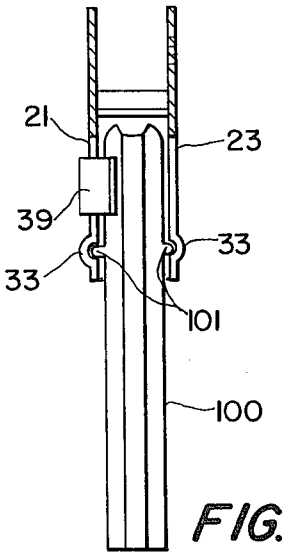
FIG. 4
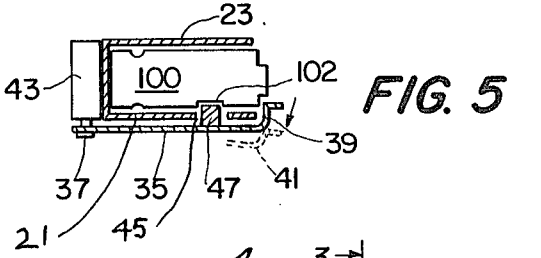
FIG. 5
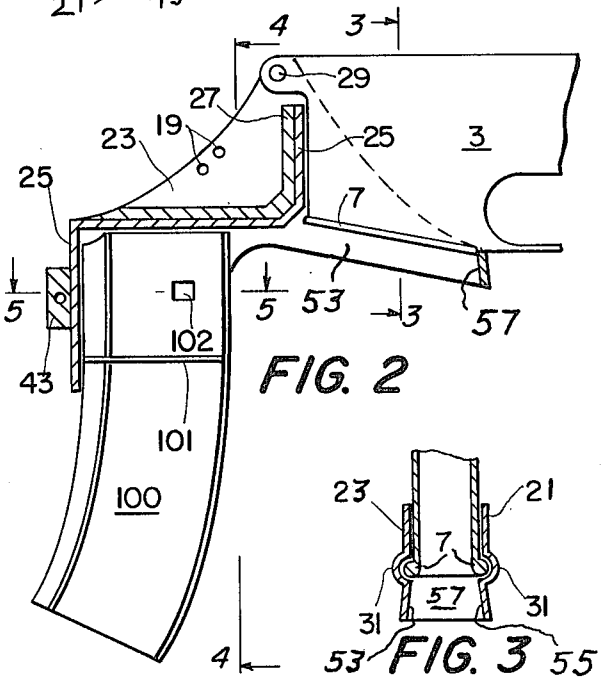
FIG. 2
FIG. 3

READY MAGAZINE HOLDER

Many firearms use detachable magazines which can be quickly removed when empty, to be replaced by full magazines. The additional magazines are usually carried in a pouch on the person of the user. In situations where the utmost firepower is needed there is necessarily a significant delay while a magazine is removed from the pouch, properly oriented, and inserted into its receptacle on the firearm.

The time required to remove the empty magazine is also significant, but some firearms are so constructed that this can be accomplished without releasing the grip of the firing hand, by pressing a release with a finger. This arrangement permits the other hand to be simultaneously reaching for a full magazine. It is readily apparent that if the full magazine is placed in a convenient location and is properly oriented, it can be quickly grasped and inserted into its receptacle on the firearm.

In addition to expediting the exchange of magazines the present invention will allow a firearm to remain unloaded, yet ready to be loaded in an extremely short time.

It is desired to point out that the word firearm is used herein in a broad sense and that it is not intended to limit the invention to any particular class of firearms. Furthermore the invention can be employed with dummy, replica, or other non-shooting "firearms".

In consideration of the foregoing, the principal object of this invention is to provide a holder which will expedite the insertion of a magazine into a receptacle on a firearm.

This and other objects of the present invention will be apparent upon reference to the following specification, taken in connection with the accompanying drawings, wherein:

FIG. 1 is a side view of a typical modern firearm having a detachable magazine.

FIG. 2 is a sectional view of a magazine holder attached to a portion of the firearm shown in FIG. 1.

FIG. 3 is a section taken in the plane indicated by line 3—3 on FIG. 2.

FIG. 4 is a section taken in the plane indicated by line 4—4 on FIG. 2.

FIG. 5 is a section taken in the plane indicated by line 5—5 on FIG. 2.

FIG. 6 is a side view of a magazine holder attached to a portion of the firearm shown in FIG. 1.

FIG. 7 shows an alternate installation of a holder.

Referring to the drawings in detail, FIG. 1 shows a typical modern rifle having an upper receiver 1, a lower receiver 3, and a hinge pin 5 connecting the upper and lower receiver. A rib 7 is formed along the lower edge of a magazine receptacle (not visible in the drawing) into which is inserted a magazine 9. A firing grip 11 is affixed to lower receiver 3, and a butt stock 13 is similarly affixed. A hand guard 15 is provided to prevent the user from being burned when barrel 17 happens to be hot. The rifle shown in FIG. 1 is of the prior art and is selected and shown merely as a convenience for purpose of disclosure of the herein-described invention.

FIG. 2 shows a portion of lower receiver 3 having affixed thereto a ready magazine holder. The holder comprises a right side plate 23, and a left side plate 21 which can not be seen in FIG. 2, but is visible in FIG. 6. The left and right plates are joined by member 25 which is shaped to form the front of the holder and its top, and to rest against the front of lower receiver 3 as may be seen in FIG. 2. An insulating material 27 may be affixed to member 25 in any convenient manner, to retard heat transfer from the barrel of the firearm to any magazine in the holder. The holder is fixed to the firearm by a pin 29, passing through suitable holes in plates 23 and 21 and through the hinge pin holes on the upper and lower receivers of the firearm. Hinge pin 5 is removed and a longer pin is provided for use with the holder.

Holes 19 are provided in the right and left side plates for storage and handling of the hinge pins when the holder is being affixed to, or removed from, the firearm.

To prevent the holder from rocking on the hinge pin, corrugations 31 are formed in each side plate. These are so located that they engage ribs 7 on the firearm, as may be seen in FIGS. 3 and 6.

In FIGS. 2 and 4 it may be noted that magazine 100 has external horizontal ribs 101 on its sides. The magazine is supported in the holder by engagement of these ribs with channels formed by corrugations 33 on side plates 21 and 23. As the rear of the holder is open, the magazine can be inserted into and removed from the holder by sliding it in or out of the rear of the holder. In order that it may slide freely, the supporting channels (formed by corrugations 33) can be coated with a substance having a low co-efficient of friction.

To retain the magazine in the holder, detent means is provided. A resilient latch 35 is mounted on a lug 43 by a fastener 37. The lug is affixed to member 25 in any convenient manner. The latch has a lip 39 which is biased toward the rear surface of magazine 100, so as to prevent its sliding out of the holder as may be understood from FIG. 5. When it is desired to remove the magazine, latch 35 is sprung to its alternate position 41, as indicated by the arrow and broken lines on FIG. 5. Although the latch is shown on the left side of the holder it could be positioned on the right side, if so desired.

The resilient latch may be so arranged relative to fastener 37 that it may be pivoted to a position at which it cannot engage a magazine in the holder. This is shown in FIG. 6. If desired, both a right side and a left side latch could be provided. The user could choose the one which he finds most convenient, and pivot the other to the ineffective position.

Some existing magazines do not have an external rib such as 101. But all magazines have some feature designed to co-operate with a magazine retaining latch in a firearm. In FIG. 2, magazine 100 has a rectangular recess 102 formed in its side for this purpose. If the said magazine did not have ribs 101, it could be supported in the holder via recess 102 in the following manner.

Formed in left side plate 21 is a rectangular hole 45 having dimensions slightly greater than those of recess 102. Hole 45 is so positioned as to be substantially aligned with recess 102 when a magazine is inserted into the holder. Carried on latch 35 is a block 47 which is dimensioned and positioned so as to be capable of passing through hole 45 and engaging in recess 102. This arrangement is shown in FIG. 5. The weight of the magazine is transmitted by recess 102 to block 47 and then to side plate 21. The magazine is released from the holder by springing latch 35 away from side plate 21 thereby disengaging the block from the recess.

The rear portion of each side plate forms a guide for controlling movement of a magazine from its position as shown in FIG. 2, toward the magazine receptacle on the rifle. The left side guide 55 is shown in FIG. 3, and the right side guide 53 is shown in FIGS. 2 and 3. Also shown in FIG. 2 is a stop 57, which is fixed between guides 53 and 55 so as to be adjacent to the rear wall of the magazine receptacle when the holder is mounted on a firearm. As may be seen in FIG. 2, a portion of member 25 can also guide movement of the magazine.

FIG. 7 shows an alternate construction. A magazine holder 49 is manufactured as a part of lower receiver 3 of the rifle. The holder includes details similar to those already described for the separate, attachable holder. Furthermore, the holder could be made to support two magazines in tandem. This is indicated by broken lines 51, on FIG. 7 which shown a position for an additional magazine.

In operation, a holder such as that illustrated in FIGS. 2, 3, 4 and 5, is mounted on a rifle such as that shown in FIG. 1, (or on some other firearm). As shown in FIG. 6 the holder is supported by pin 29 engaging the holes in the receivers of the firearm, and is held steady by corrugations 31 engaging ribs 7 on the firearm. A magazine, filled with cartridges, is then inserted into the holder as shown in FIGS. 2, 4, and 5. If desired, this magazine can be shorter than the usual magazine so as to protrude less from the holder.

While the magazine remains in the holder, in a "ready" status, the firearm can be loaded in the usual manner by inserting other magazines directly into the magazine receptacle on the firearm.

If the user empties the magazine in the receptacle, and he needs to continue firing as quickly as possible, he can drop the expended magazine and quickly move the "ready" magazine to the receptacle. This is done by disengaging latch 35 and sliding the magazine to the rear with its upper portion guided by member 25 and by guides 53 and 55. When the upper rear of the magazine contacts stop 57, the user pushes it upward into the receptacle in the usual manner. The time required to thus insert a "ready" magazine into the receptacle is significantly less than the time required to insert one from a belt pouch.

It should be pointed out that the drawings are for purpose of disclosure only, and that changes in detail may be made to adapt the invention to various firearms. Furthermore a ready magazine holder can be made integral with various parts of a firearm, such as a receiver, a fore grip, or other part.

What I claim is:

1. A ready magazine holder comprising: a frame adapted for mounting on a firearm; support means on said frame adapted for supporting a magazine in a correct orientation for insertion into a magazine receptacle on said firearm; guide means on said frame positionally adapted for directing translational movement of said magazine from said support means toward said receptacle; and stop means on said frame positionally adapted for terminating said movement with said magazine aligned with said receptacle.

2. A ready magazine holder comprising: a frame adapted for mounting on a firearm; support means on said frame adapted for engagement with external rib means on a magazine whereby said magazine is supported in a correct orientation for insertion into a magazine receptacle on said firearm; guide means on said frame positionally adapted for directing translational movement of said magazine from said support means toward said receptacle; and stop means on said frame positionally adapted for terminating said movement when said magazine is aligned with said receptacle.

3. A holder as set forth in claim 2 wherein said guide means is positionally adapted for directing said movement in more than one plane.

4. A holder as set forth in claim 2 wherein the orientation of said magazine can remain substantially constant during said movement.

5. A holder as set forth in claim 2 further provided with releaseable detent means positionally adapted to prevent movement of a magazine from said support means.

6. A holder as set forth in claim 5 wherein said detent means can be adjusted to a position whereat it cannot prevent said movement.

7. A holder as set forth in claim 2 wherein said support means is coated with a substance having a low co-efficient of friction.

8. A holder as set forth in claim 2 and fabricated as an integral part of a firearm.

9. A holder as set forth in claim 2 further provided with means on said frame for storage of a fastener, said fastener being adapted to affix said holder to said firearm.

* * * * *